US009085409B2

(12) United States Patent
Brall

(10) Patent No.: US 9,085,409 B2
(45) Date of Patent: Jul. 21, 2015

(54) DISPENSING HEAD FOR A TUBE AND TUBE HAVING A DISPENSING HEAD

(75) Inventor: Dominik Brall, Moos (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 14/111,649

(22) PCT Filed: Apr. 13, 2012

(86) PCT No.: PCT/EP2012/056793

§ 371 (c)(1), (2), (4) Date: Nov. 4, 2013

(87) PCT Pub. No.: WO2012/140205

PCT Pub. Date: Oct. 18, 2012

(65) Prior Publication Data

US 2014/0048570 A1 Feb. 20, 2014

(30) Foreign Application Priority Data

Apr. 14, 2011 (DE) ..... 10 2011 007 396

(51) Int. Cl.
*B65D 25/40* (2006.01)
*B65D 83/44* (2006.01)
(Continued)

(52) U.S. Cl.
CPC ..... *B65D 83/44* (2013.01); *B65D 35/46* (2013.01); *B65D 47/2068* (2013.01); *B65D 35/08* (2013.01); *B65D 47/20* (2013.01); *B65D 47/2018* (2013.01); *B65D 47/2075* (2013.01)

(58) Field of Classification Search
CPC ..... B65D 1/32; B65D 35/08; B65D 35/00; B65D 35/12; B65D 47/2018; B65D 47/2068; B65D 47/2075; B65D 47/20; B65D 35/46; B65D 25/40
USPC ..... 222/92, 95, 207, 209, 212–215, 491, 222/494, 496–497
See application file for complete search history.

(56) References Cited

U.S. PATENT DOCUMENTS 2,302,539 A * 11/1942 Fuchslocher ..... 222/493
2,607,515 A * 8/1952 Felburg ..... 222/496
(Continued)

FOREIGN PATENT DOCUMENTS

CN 1207084 A 2/1999
CN 1326399 A 12/2001
(Continued)

OTHER PUBLICATIONS

Form PCT/ISA/210 International Search Report with English translation issued in PCT/EP2012/056793 dated Jun. 14, 2012 (4 pages).
(Continued)

*Primary Examiner* — Frederick C Nicolas
(74) *Attorney, Agent, or Firm* — Flynn, Thiel, Boutell & Tanis, P.C.

(57) ABSTRACT

A dispensing head for a tube with a housing having a receiving chamber an outlet fitting of the tube an outlet opening, and an interior space surrounded by walls of the housing. An annular wall section of the housing separates the receiving chamber from an annular area of the interior space of the housing, an outlet valve is provided in the interior space, the outlet valve having a valve body, a valve seat and a pressure chamber designed so that the valve body and the valve seat are movable from a closed position to an open position by pressurization of the medium contained in the pressure chamber in order to allow discharge of the medium through the discharge opening. A medium path is provided within the housing, which connects an inlet opening to the pressure chamber.

18 Claims, 3 Drawing Sheets

(51) Int. Cl.

| | |
|---|---|
| ***B65D 35/46*** | (2006.01) |
| *B65D 35/08* | (2006.01) |
| *B65D 47/20* | (2006.01) |

(56) References Cited

U.S. PATENT DOCUMENTS

| | | | | |
|---|---|---|---|---|
| 2,755,974 | A * | 7/1956 | Godfrey | 222/494 |
| 3,828,985 | A * | 8/1974 | Schindler | 222/207 |
| 5,195,665 | A * | 3/1993 | Lina | 222/496 |
| 5,213,236 | A | 5/1993 | Brown et al. | |
| 5,275,312 | A | 1/1994 | Labruzzo | |
| 5,339,995 | A | 8/1994 | Brown et al. | |
| 5,377,877 | A | 1/1995 | Brown et al. | |
| 5,409,144 | A | 4/1995 | Brown | |
| 5,439,143 | A | 8/1995 | Brown et al. | |
| 5,454,494 | A | 10/1995 | Lechelle | |
| 5,839,614 | A | 11/1998 | Brown | |
| 6,279,783 | B1 | 8/2001 | Brown et al. | |
| 6,309,059 | B1 | 10/2001 | Ritter | |
| 6,427,874 | B2 | 8/2002 | Brown et al. | |
| 7,004,005 | B2 | 2/2006 | Feldmann et al. | |
| 7,059,501 | B2 | 6/2006 | Masuda | |
| 7,077,296 | B2 | 7/2006 | Brown et al. | |
| 8,534,509 | B2 * | 9/2013 | Duquet | 222/496 |
| 2001/0025862 | A1 | 10/2001 | Brown et al. | |
| 2002/0158083 | A1 | 10/2002 | Brown et al. | |
| 2003/0230596 | A1 | 12/2003 | Masuda | |
| 2004/0055356 | A1 | 3/2004 | Feldmann et al. | |
| 2007/0289651 | A1 | 12/2007 | Brown et al. | |
| 2012/0033898 | A1 | 2/2012 | Barron | |
| 2012/0111900 | A1 * | 5/2012 | Duquet | 222/496 |

FOREIGN PATENT DOCUMENTS

| | | | |
|---|---|---|---|
| DE | 101 57 423 | A1 | 6/2003 |
| DE | 102 32 098 | A1 | 2/2004 |
| DE | 603 08 447 | T2 | 10/2007 |
| DE | 10 2010 029 908 | A1 | 12/2011 |
| EP | 0 549 015 | A1 | 6/1993 |

OTHER PUBLICATIONS

Office Action of German Patent Office issued in German Application No. 10 2011 007 396.5 dated Jan. 9, 2012 (5 pages).

Search Report of People's Republic of China Intellectual Property Office issued in Application No. 201280018514.9 dated Dec. 3, 2014 (2 pages).

* cited by examiner

DISPENSING HEAD FOR A TUBE AND TUBE HAVING A DISPENSING HEAD

FIELD OF APPLICATION AND PRIOR ART

The invention relates to a dispensing head for a tube for discharge of medium from the tube with a flat outer housing having on the rear end face facing the tube a receiving chamber for inserting and fixing an outlet fitting of the tube and on an opposite end face an outlet opening for discharge of the medium; an interior space surrounded by walls of the outer housing, wherein an annular wall section of the outer housing separates the receiving chamber from an annular area of the interior space of the outer housing that surrounds the annular wall section on the outside; an outlet valve provided in the interior space, the outlet valve having a valve body and a valve seat and a pressure chamber, which chamber is designed in such a way that the valve body and the valve seat can be spaced to each other from a closed position to an open position by pressurization of the medium contained in the pressure chamber, in order to permit discharge of the medium from the pressure chamber through the discharge opening; and a medium path within the housing, by means of which path an inlet opening on the receiving chamber is connected to the pressure chamber. Furthermore, the invention relates also to a tube having a dispensing head, wherein the tube comprises an outlet fitting having a reduced outer diameter as compared to a maximum tube diameter, and wherein the outlet fitting is fixed in an insertion direction in an receiving chamber of the dispensing head.

Tubes and very simple dispensing heads therefor are generally known, in particular for accommodation and discharge of toothpaste. The tubes employed therefor include, in most cases, an outlet fitting provided with an external thread, the fitting having a substantially reduced diameter as compared to the external diameter of the tube. Accordingly, with toothpaste tubes the dispensing head is mostly screwed onto the outlet fitting. For protection of the medium contained in the tube, toothpaste tubes are typically provided with a pivotably movable protective cap on the dispensing head, wherein during non-use the cap is locked in a position closing the outlet opening of the dispensing head.

There is also a dispensing head for tubes known from the internal prior art of the applicant, wherein a pressure controlled outlet valve is provided and capable of opening automatically upon pressurization of the medium in the tube and closing automatically upon cease of said pressurization. Thereby, a protection against contamination of the medium can be achieved, which allows use of a tube including such a dispensing head for accommodation and discharge of media free of preservative agents.

During development of dispensing heads for tubes including such a valve it has been observed that a compact structural design is difficult to realize. However, such a compact structural design, inter alia, is required for aesthetic reasons, and in particular in the case of tubes for cosmetic products. Furthermore, it has been observed that with central supply of the medium to the pressure chamber, there is a risk that outer zones of the pressure chamber during pressurization of the medium in the pressure chamber still contain air which upon opening the outlet valve expands abruptly and thus causes an undesirable sudden discharge of medium.

OBJECT AND SOLUTION

An object of the invention is to further develop a dispensing head of the aforementioned type for a tube, such that the drawbacks of the prior art are overcome.

According to the invention, said object is achieved in a first aspect of the invention by a dispensing head of the aforementioned type, wherein the medium path extends from the inlet opening through the annular area of the interior space of the outer housing to the pressure chamber so that the medium flows on the path from the inlet opening to the pressure chamber in some sections in a direction which includes at least one direction component that is directed opposite to an insertion direction of the outlet fitting into the receiving chamber.

The dispensing head according to the invention comprises on opposite sides on the one hand, the receiving chamber for the outlet fitting of the tube and on the other hand, the discharge opening. The above mentioned insertion direction of the tube is defined by the receiving chamber. The insertion direction refers to the positional displacement of the tube relative to the dispensing head during fixing of the tube to the dispensing head. The rotary position of the tube is not important in that context so that even when fixing the tube by means of a thread, the insertion direction extends in the direction of the thread axis.

The outlet opening of the dispensing head is provided on the end face of the tube head opposite to the rear end face, and preferably configured such that it is adapted to medium discharge in the direction of the insertion direction.

Fixing of the outlet fitting of the tube in the receiving chamber of the dispensing head preferably is achieved by means of a form-fitting clamping connection, wherein on the inner surface of the receiving chamber and on the outer surface of the outlet fitting of the tube corresponding profiles are provided. The above mentioned configuration including a thread is also considered to be advantageous.

The quintessence of the first aspect of the invention is that the medium path, connecting the at least one inlet opening to the pressure chamber and thus also the outlet opening, extends at least in some sections through that annular area of the interior space which is delimited on the interior side by the annular wall section of the receiving chamber. Consequently, the medium path passes such that the medium, which flows into the dispensing head at the inlet opening, is deflected, and thereby in phases flows opposite to the insertion direction, or in a direction which includes at least one direction component opposite to the insertion direction. The annular wall section of the receiving chamber does not mandatorily need to contact the medium. Instead, even further walls may be provided exterior to the annular wall section and delimit the flow path of the medium.

Said structural design results in a considerable gain in space. As the medium is deflected into the annular space surrounding the receiving chamber, the medium can be supplied from here outwards and then further in the insertion direction to reach the pressure chamber. Thereby, a great portion of the interior space of the outer housing is not needed for the medium path, so that the space may be used otherwise, in particular for accommodation of relevant parts of the outlet valve. Configuration of the dispensing head in the desired flat structural design is permitted thereby, and nevertheless, there is sufficient space for accommodation of the outlet valve available.

The second aspect of the invention, which preferably is realized together with the first aspect of the invention, provides that the pressure chamber extends between an internal side of an end face wall of the outer housing and a countersurface disposed essentially parallel thereto in the interior space of the outer housing, and that the medium path extends from the inlet opening in relation to the insertion direction of the outlet fitting into the receiving chamber outwards so that the medium coming from the inlet opening can flow only at an outer peripheral region into the pressure chamber. Accordingly, what is provided in said configuration is that the medium does not flow axially and without substantial change of direction from the inlet opening of the dispensing head to the outlet opening, but that the medium is supplied from the inlet opening radially outwards so far so as to allow flow past the countersurface and into the pressure chamber from the outside. From the outer edge of the pressure chamber the medium then flows further in the direction to the center of the pressure chamber, at which the outlet opening is provided.

Referring to the first aspect of the invention, a particular advantage is that the dispensing head has a spring for force application to the valve body in the direction of the valve seat, wherein said spring is at least partially disposed in the annular space of the interior space. Thus, available installation space surrounding the receiving chamber of the dispensing head is used for said spring. Since comparatively long spring lengths can be realized thereby, adjustment of the opening performance of the outlet valve is feasible in a particularly convenient and precise manner. It is of particular advantage, if the spring is a helical spring and surrounds the receiving chamber at least in sections. Thus, the annular walls of the receiving chamber or corresponding annular walls of an inner housing, which will be explained below, can also be used to achieve fixing in position of the spring transverse to the insertion direction.

Furthermore, it is of particular advantage if an inner housing is provided within the interior space of the outer housing, wherein the medium path extends between outer walls of the inner housing and inner walls of the outer housing, and wherein furthermore an interior space of the inner housing is closed in a liquid-tight manner relative to the medium path.

The inner housing satisfies a plurality of purposes. On the one hand, in the interior space of the housing, functional elements of the outlet valve can be accommodated which are protected from the environment by a liquid-tight configuration of the inner housing. On the other hand, due to the outer contour of the housing and in cooperation together with the internal side of the walls of the outer housing, the housing can define the one or more medium paths from the inlet opening to the pressure chamber. By means of a shape, which is matched to the inner contour of the outer housing, excessively large dead volumes can be prevented in the media path, that is spaces, wherein medium remains, and wherefrom said medium cannot be removed after draining of the tube. In particular, the inner housing may be provided to include a deepening, wherein the annular wall of the outer housing projects into the deepening. The deepening allows maximization of the internal volume of the inner housing. Additionally, the deepening, with the annular wall section of the outer housing inserted therein, can be used to support a helical valve spring in the above mentioned ways and manners.

Preferably, the inner housing constitutes a countersurface to delimit the pressure chamber, with the valve body provided on said surface. Therein, the countersurface is at least partially displaceable relative to a base portion of the inner housing which is provided fixed in position relative to the outer housing. The feature can be achieved in that the countersurface is slidably guided on the base portion of the inner housing. However, preferred is that the countersurface is made of two different materials of differing deformability. Thereby it is feasible to fixedly connect the countersurface to the base portion and yet achieve movability of the valve body. For that purpose, preferably an annular section made of a material exhibiting superior deformability is disposed between an exterior outer ring and the valve body of the countersurface, with the countersurface made of a material exhibiting minor deformability.

In particular in respect of the second aspect of the invention, it is considered to be particularly advantageous that the medium path is at least in sections formed by ducts which are formed by recesses in the outer housing and/or in the inner housing, and which are circumferentially closed from the respective other housing, wherein the ducts in the vicinity of the ending into the pressure chamber have an enlargement of the cross sectional area. The enlargement of the cross sectional area permits dead volumes to be kept small and still ensures that the medium flows into the pressure chamber over the entire circumference or at least over almost the entire circumference (more than 50%). Development of air bubbles is effectively prevented thereby.

Furthermore, the invention relates to a tube having a dispensing head according to the invention. Therein, the tube comprises an outlet fitting having a reduced outer diameter as compared to a maximum tube diameter. The outlet fitting is fixed in an insertion direction in an receiving chamber of the dispensing head.

BRIEF DESCRIPTION OF THE DRAWINGS

Further aspects and advantages of the invention will become apparent from the claims and also from the description below of a preferred exemplary embodiment of the invention, as illustrated with reference to the Figures in which:

DETAILED DESCRIPTION OF THE EXEMPLARY EMBODIMENT

Figure 1A:
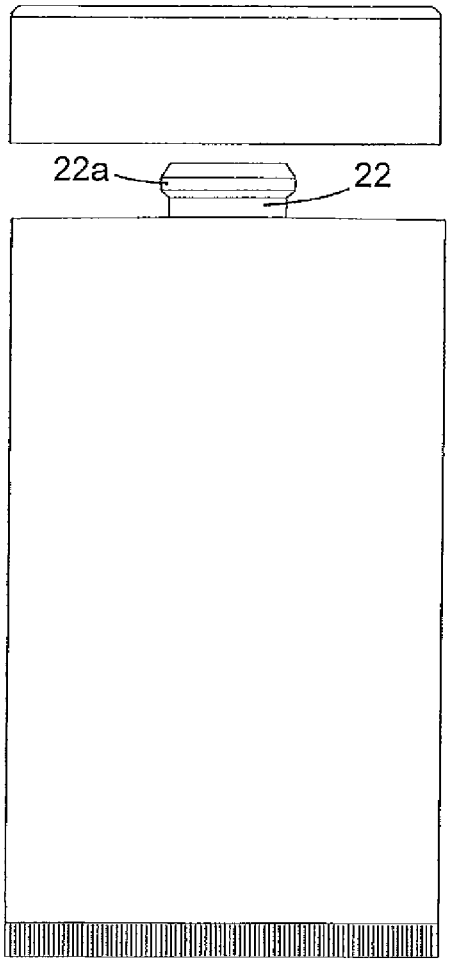
FIGS. 1*a* and 1*b* illustrate a tube according to the invention including a dispensing head according to the invention.
Figure 1B:
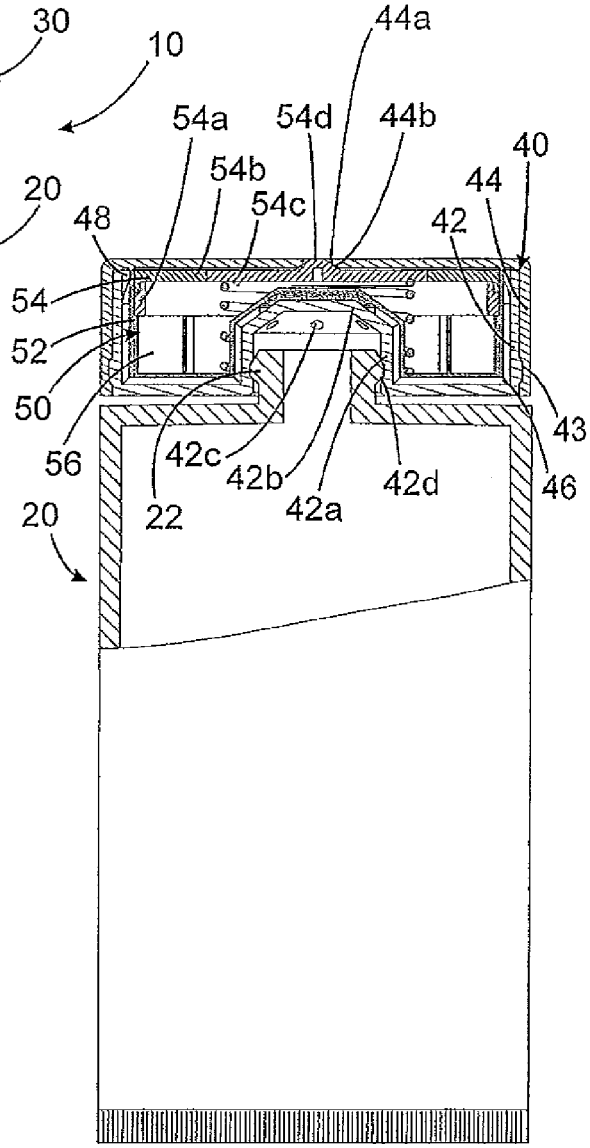

FIGS. 1*a* and 1*b* show a tube 10 according to the invention having a tube body 20 and a dispensing head 30 according to the invention. Therein, FIG. 1*a* shows the tube 10 according to the invention in a non-sectional illustration and in a not yet assembled condition of the dispensing head, and FIG. 1*b* shows the tube according to the invention in a completely assembled condition in a partially sectional view. As apparent from FIG. 1*b*, the dispensing head 30 includes an outer housing 40, which housing is composed of an inner shell 42 and an outer shell 44. The shells are fixedly secured and immobilized relative to another by detent means 43. The inner shell 42 defines a central receiving chamber 32 surrounded by an annular wall 42*a* of the inner shell 42. An end face wall 42*b* is provided on the bottom of the receiving chamber 32, wherein inlet openings 42*c* are provided to allow supply of medium into the dispensing head 30 through the inlet opening 42*c*. The receiving chamber 32 is arranged for receiving the outlet fitting 22 of the tube body 20. For that purpose, the tube body is provided with a thickening 22*a* on the exterior, and the thickening engages a peripheral groove 42*d* on the annular wall section 42*a*. Instead of such a form-fitting detent connection, the outlet fitting 22 could as well be engaging in an internal thread provided on the interior surface of the annular wall section 42*a*, in a not illustrated embodiment.

The outer shell 44 includes an outlet opening 44*a* to allow discharge of the medium from the dispensing head to an environment. The inner shell 42 and the outer shell 44 together define an interior space 48 of the outer housing 40. Within the interior space 48 an inner housing 50 is provided. The inner housing 50 comprises a base portion 52 and a countersurface portion 54. Together the base portion 52 and the countersurface portion 54 close an interior space 56 of the inner housing 50 in a liquid-tight manner. During the intended use, there is no medium whatsoever entering into the interior space 56. The base portion 52 has a shape similar to that of the bottom shell 42. Thus, the base portion 52 in particular has walls 52*a* which define a deepening, into which plunges the receiving chamber 32. The countersurface portion 54 is a component made of two different types of synthetic material. An exterior annular section 54*a* and a central section 54*c* are manufactured from a hardly deformable synthetic material, while an intermediate annular zone 54*b* is manufactured from a readily deformable synthetic material so that the central zone 54*c* is displaceable relative to the edge zone 54*a* counter to the main direction 2. A helical spring 58 is provided within the interior space 56 of the inner housing 50. The spring rests on a bottom surface of the base portion 52 and on the central section 54*c* of the countersurface section 54 supported by the deepening 52*a*, and urges the countersurface section together with a valve body 54*d* formed thereon in the direction of the outlet opening 44*a* and against an internal valve surface 44*b* provided therein.

Figure 2:
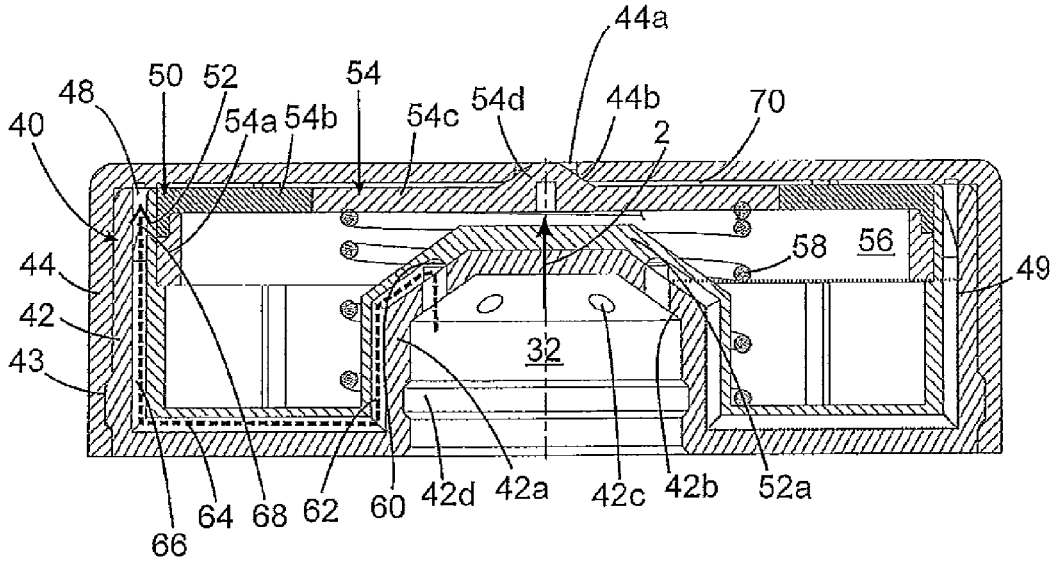
FIG. 2 illustrates the dispensing head in an enlarged state and in the closing position thereof.
Figure 3:
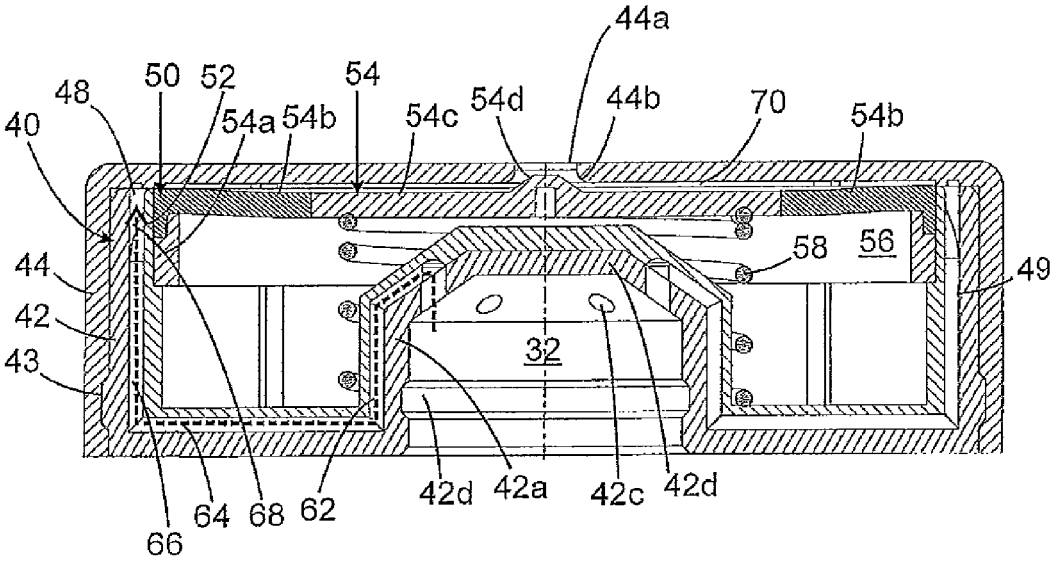
FIG. 3 illustrates the dispensing head of FIG. 2 in the opening position thereof.
Figure 4:
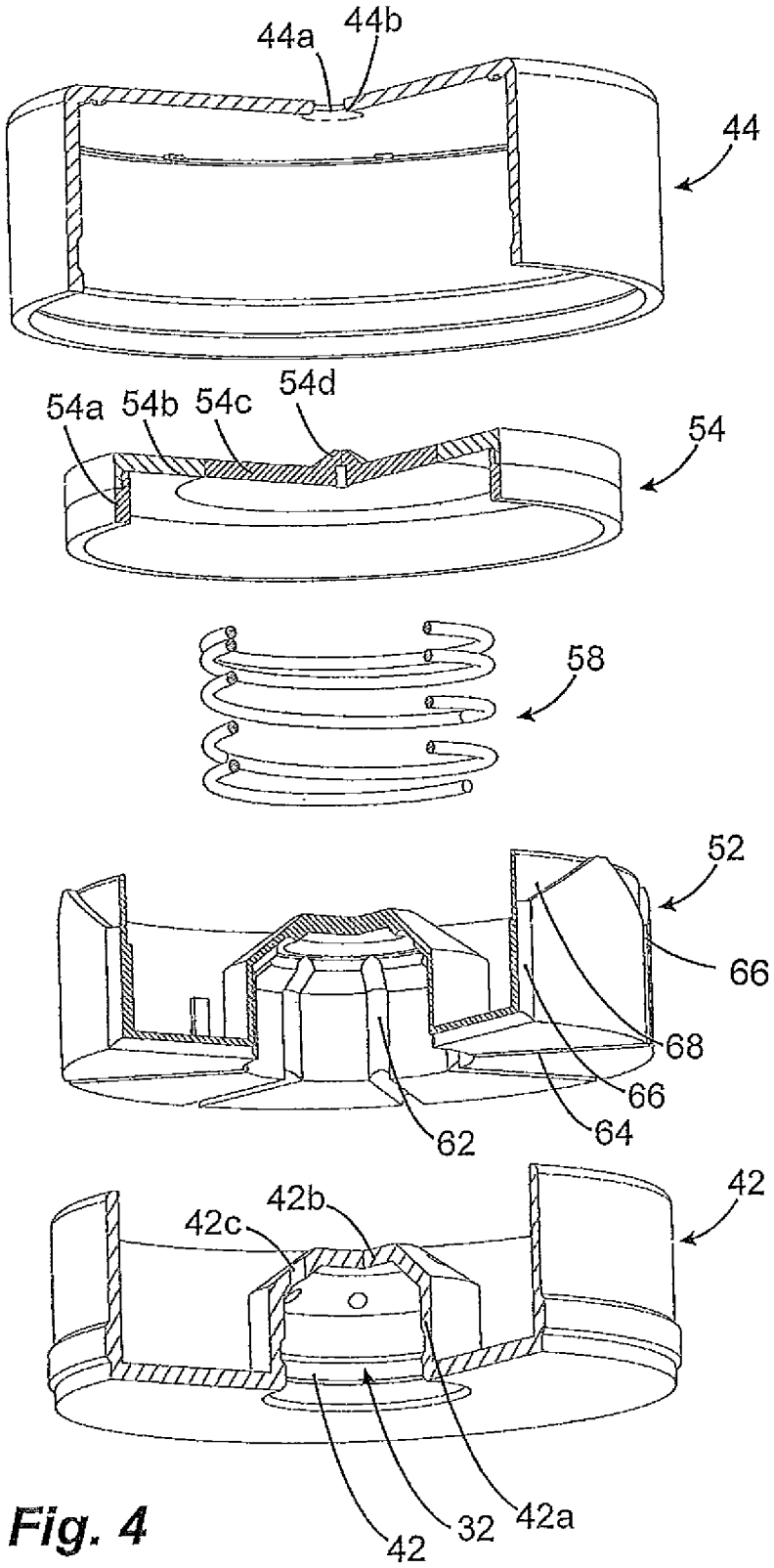
FIG. 4 illustrates an exploded view of the dispensing head of FIGS. 2 and 3.

Referring to FIGS. 2 and 3, the functional operation of the dispensing head is described. FIG. 2 shows the dispensing head in an enlarged view in the closed position thereof. To allow medium to pass from the receiving chamber 32 up to the discharge opening 44*a*, a medium path 60, 62, 64, 66, 68 is provided and extends from inlet openings 42*c* associated to the receiving chamber up to the pressure chamber 70 adjoining the discharge opening 44*a*. Starting from a circumferential annular zone 60, the media path initially extends between the deepening 52*a* in the base portion 52 on the one hand, and the end face wall 42*b* and the annular wall 42*a* of the inner shell 42 on the other hand, into an annular zone 49 of the interior space 48 of the outer housing 40. The duct portions 62 extend up to a bottom of the inner shell 42 and there through portions 64 radially outwards up to the cylindrical exterior wall of the inner shell 42. Then, the medium path extends in axially oriented sections 66 further in the direction of the pressure chamber 70. An end section 68 of the medium path is designed in a funnel shape, as apparent in particular from FIG. 4, so that the medium can flow into the pressure chamber 70 from the exterior over almost the entire circumference.

Upon pressurization of the medium contained in the tube body 20 by force application to the medium, the pressure propagates through the medium path and the sections 60, 62, 64, 66, 68 thereof up to the pressure chamber 70. Therein, with a closed outlet valve, the pressure results in a partial deformation of the countersurface section 54 and thus a spacing of the valve body 54*d* from the valve seat 44*b*. Thereby, the outlet opening 44*a* is released and the pressurized medium can exit in the main direction 2.

The media supply into the pressure chamber 70 from outside ensures that any air present is discharged reliably from the pressure chamber 70 through the discharge opening 44*a*. Thus, there is no risk that upon start of a discharge procedure, there are air pockets in the pressure chamber 70 remaining which are compressed during pressure application and will abruptly and unexpectedly re-expand as soon as the outlet valve opens. Furthermore, the arrangement of the medium path in said annular space 49 allows the inner housing 50 to occupy a large portion of the interior space 48 of the outer housing 40. Thus, there is in particular ample space to dispose the spring 58 therein.

The invention claimed is:

1. A dispensing head for a tube for discharge of medium from the tube, the dispensing head comprising:

a flat outer housing having on a rear end face facing the tube a receiving chamber for inserting and fixing an outlet fitting of the tube and on an opposite end face an outlet opening for discharge of the medium;

an interior space surrounded by the outer housing, wherein an annular wall section of the outer housing separates the receiving chamber from an annular area of the interior space of the outer housing that surrounds the annular wall section on the outside;

an inner housing provided within the interior space of the outer housing;

an outlet valve provided in the interior space, the outlet valve having a valve body, a valve seat and a pressure chamber, the pressure chamber being designed such that the valve body and the valve seat are movable relative to one another from a closed position to a spaced-apart open position by pressurization of the medium contained in the pressure chamber in order to permit discharge of the medium from the pressure chamber through the outlet opening; and a medium path within the housing, the medium path connecting an inlet opening on the receiving chamber to the pressure chamber, wherein the medium path extends between walls of the inner housing and walls of the outer housing from the inlet opening through the annular area of the interior space of the outer housing to the pressure chamber, the medium being deflected by the walls of the inner housing and the outer housing in order to flow in some sections in a direction which includes at least one direction component that is directed opposite to an insertion direction of the outlet fitting into the receiving chamber, and a part of the annular area through which the medium path extends is disposed outwardly, in a direction transverse to the insertion direction, of the inner housing.

2. The dispensing head according to claim 1, wherein the pressure chamber extends between an internal side of an end face wall of the outer housing and a countersurface disposed essentially parallel thereto in the interior space of the outer housing, and the medium path extends from the inlet opening in relation to the insertion direction outwards and from there leads into the pressure chamber so that the medium coming from the inlet opening can flow only at an outer peripheral region into the pressure chamber.

3. The dispensing head according to claim 1, wherein the dispensing head has a spring for force application to the valve body in the direction of the valve seat, and said spring is at least partially disposed in the annular area of the interior space.

4. The dispensing head according to claim 3, wherein the spring is a helical spring and surrounds the receiving chamber at least in sections.

5. The dispensing head according to claim 1, wherein an interior space of the inner housing is closed in a liquid-tight manner relative to the medium path.

6. The dispensing head according to claim 1, wherein the inner housing has a deepening, and the annular wall section of the outer housing projects into the deepening.

7. The dispensing head according to claim 2, wherein the inner housing includes the countersurface delimiting the pressure chamber, with the valve body provided on the countersurface, wherein the countersurface is displaceable at least partially relative to a base portion of the inner housing fixed in position relative to the outer housing, and the countersurface is made of two different materials of differing deformability.

8. The dispensing head according to claim 1, wherein the medium path is formed at least partially by ducts, the ducts being formed by deepenings in at least one of the outer housing and the inner housing, the ducts being circumferentially closed by the other one of the outer housing and the inner housing, wherein and the ducts have an enlarged cross sectional area in the vicinity of ends thereof which lead into the pressure chamber.

9. The dispensing head according to claim 1, wherein the part of the annular area through which the medium path extends is disposed exteriorly of the inner housing.

10. A tube having a dispensing head for discharge of medium from the tube, wherein the tube comprises an outlet fitting having a reduced outer diameter as compared to a maximum tube diameter, the dispensing head comprising a flat outer housing having on a rear end face facing the tube a receiving chamber and on an opposite end face an outlet opening for discharge of the medium, said outlet fitting being fixed in an insertion direction in the receiving chamber, the dispensing head having an interior space surrounded by walls of the outer housing, wherein an annular wall section of the outer housing separates the receiving chamber from an annular area of the interior space of the outer housing that surrounds the annular wall section on the outside, the dispensing head having an outlet valve provided in the interior space, the outlet valve having a valve body, a valve seat and a pressure chamber, the pressure chamber being designed such that the valve body and the valve seat are movable relative to one another from a closed position to a spaced-apart open position by pressurization of the medium contained in the pressure chamber in order to permit discharge of the medium from the pressure chamber through the outlet opening, the dispensing head having a medium path within the housing, the medium path connecting an inlet opening on the receiving chamber to the pressure chamber, wherein the pressure chamber extends between an internal side of an end face wall of the outer housing and a countersurface disposed essentially parallel thereto in the interior space of the outer housing, and the medium path extends from the inlet opening in relation to the insertion direction outwards and from there leads into the pressure chamber so that the medium coming from the inlet opening can flow only at an outer peripheral region into the pressure chamber.

11. A dispensing head for a tube for discharge of medium from the tube, the dispensing head comprising:

a flat outer housing having on a rear end face facing the tube a receiving chamber for inserting and fixing an outlet fitting of the tube and on an opposite end face an outlet opening for discharge of the medium;

an interior space surrounded by walls of the outer housing, wherein an annular wall section of the outer housing separates the receiving chamber from an annular area of the interior space of the outer housing that surrounds the annular wall section on the outside;

an outlet valve provided in the interior space, the outlet valve having a valve body, a valve seat and a pressure chamber, the pressure chamber being designed such that the valve body and the valve seat are movable relative to one another from a closed position to a spaced-apart open position by pressurization of the medium contained in the pressure chamber in order to permit discharge of the medium from the pressure chamber through the outlet opening; and a medium path within the housing, the medium path connecting an inlet opening on the receiving chamber to the pressure chamber, wherein the pressure chamber extends between an internal side of an end face wall of the outer housing and a countersurface disposed essentially parallel thereto in the interior space of the outer housing, and the medium path extends from the inlet opening in relation to the insertion direction outwards and from there leads into the pressure chamber so that the medium coming from the inlet opening can flow only at an outer peripheral region into the pressure chamber.

12. The dispensing head according to claim 11, wherein the medium path extends from the inlet opening through the annular area of the interior space of the outer housing to the pressure chamber such that the medium flows on the path from the inlet opening to the pressure chamber in some sections in a direction which includes at least one direction component that is directed opposite to an insertion direction of the outlet fitting into the receiving chamber.

13. The dispensing head according to claim 11, wherein the dispensing head has a spring for force application to the valve body in the direction of the valve seat, said spring being at least partially disposed in the annular area of the interior space.

14. The dispensing head according to claim 13 wherein the spring is a helical spring and surrounds the receiving chamber at least in sections.

15. The dispensing head according to claim 11, wherein within the interior space of the outer housing an inner housing is provided, the medium path extending between walls of the inner housing and walls of the outer housing, and an interior space of the inner housing is closed in a liquid-tight manner relative to the medium path.

16. The dispensing head according to claim 15, wherein the inner housing has a deepening, and the annular wall section of the outer housing projects into the deepening.

17. The dispensing head according to claim 15, wherein the inner housing includes the countersurface delimiting the pressure chamber, with the valve body provided on the countersurface, wherein the countersurface is displaceable at least partially relative to a base portion of the inner housing fixed in position relative to the outer housing, and the countersurface is made of two different materials of differing deformability.

18. The dispensing head according to claim 11, further including an inner housing provided within the interior space of the outer housing, wherein the medium path is formed at least partially by ducts, the ducts being formed by deepenings in at least one of the outer housing and the inner housing, the ducts being circumferentially closed by the other one of the outer housing and the inner housing, and the ducts have an enlarged cross sectional area in the vicinity of ends thereof which lead into the pressure chamber.

* * * * *